United States Patent [19]

Felsch

[11] 4,369,421

[45] Jan. 18, 1983

[54] SAFETY DEVICE WITH DELAY

[76] Inventor: Christian Felsch, Blaurakenweg 5, 4600 Dortmund 30, Fed. Rep. of Germany

[21] Appl. No.: 283,815

[22] Filed: Jul. 16, 1981

[30] Foreign Application Priority Data

Jul. 18, 1980 [DE] Fed. Rep. of Germany ..... 3027245

[51] Int. Cl.[3] ..... H01H 85/04

[52] U.S. Cl. ..... 337/163; 337/296

[58] Field of Search ..... 337/163, 290, 295, 296, 337/297

[56] References Cited

U.S. PATENT DOCUMENTS 3,845,439 10/1974 Deelman ..... 337/295 X
3,869,689 3/1975 Kasamatu ..... 337/296 X
3,940,728 2/1976 Kosamatu et al. ..... 337/295 X
4,208,645 6/1980 Harmon et al. ..... 337/297

*Primary Examiner*—George Harris
*Attorney, Agent, or Firm*—Max Fogiel

[57] ABSTRACT

A delayed safety device in which a meltable conductor engages two contacts. The meltable conductor is shielded by a non-conductive sleeve which serves also as touch protection. The meltable conductor is of a base metal having a coating of synthetic plastic which decomposes when heated and emits hydrochloric acid. The acid reacts with the conductor and reduces its cross-section. The coating protects the conductor against corrosion, and provides the conductor with switching-off characteristics present when the conductor is made of a noble metal.

8 Claims, 5 Drawing Figures

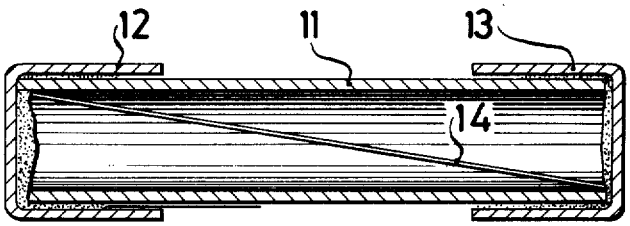
FIG.1
FIG. 2
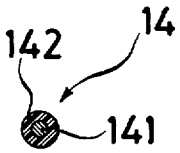
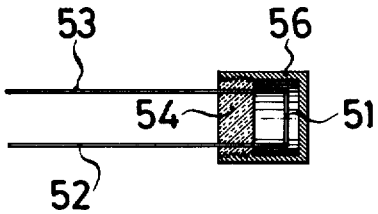
FIG. 5

TIME
min
s
ms
60
10
5
1
50
10
1
500
100
10
1
0,15
1
1,5
2
2,5
3
3,5
4
5
6
7
8
9
10
15
I
II
III
III'

TIME
min
s
ms
60
10
5
1
50
10
1
500
100
10
1
0,15
1
15
2
25
3
35
4
5
6
7
8
9
10
15
II
IV
IV'
I

SAFETY DEVICE WITH DELAY

The invention relates to a safety device with delay, consisting of a meltable conductor engaging two contacts, which is shielded by a non-conductive sleeve serving as a touch protection.

Such safety devices should reliably be able to switch off high starting currents of brief duration, and overload currents of larger duration. The so-called normed switch-off characteristic which is defined by current-time—characteristic lines respectively the diffusion range—is determined by the intended use and can in particular be predetermined by selection of the material for the meltable conductor as well as dimensioning of the same.

As a rule, the meltable conductor consists of silver or alloys thereof. The supply of the noble metal silver causes increased difficulties. To the extent that it has been suggested to use meltable conductors of inexpensive base metals, it has in practice been found, inter alia, that such meltable conductors have a comparatively low corrosion resistance.

The invention is based on the need for a safety device of the type mentioned in the beginning, which avoids the need for noble metals for the meltable conductor but meets the requirements made of it in practice, particularly with respect to corrosion resistance.

The requirement is inventively met with a safety device which is characterized in that the meltable conductor consists of a base metal or an alloy of base metals and is coated with synthetic plastic.

It may be provided for the meltable conductor to extend through an insulating tube which is closed at both ends with contact caps engaged by the metal conductor. The invention can also be realized as a safety device in which two contacts extend through a jacket of non-conductive material, between which the meltable conductor is installed (which are shorted by the meltable conductor), whereby the meltable conductor is shielded by a non-conductive cap placed on the socket. The invention is also not limited to the external form of such safety devices; rather, it is to be primarily seen in the construction of the meltable conductor in such a manner that a wire of base metal respectively of an alloy of base metals is used for the same, whereby the wire is coated with synthetic plastic.

According to a preferred embodiment the meltable conductor covering consists of a synthetic plastic which influences the durability—the characteristic of the safety device. For this, (preferably in combination with a meltable conductor of iron, aluminum or zinc or their alloys) polyvinylchloride is, for example, available. If the switch-off conditions are reached in such a safety device due to excessively high starting current or testing over-load current, the meltable conductor becomes heated. The heated meltable conductor decomposes the polyvinylchloride cover. The thereby freed chlorine hydrocarbon respectively the chlorine reacts with the meltable conductor under formation of chlorides, whereby the diameter of the conductor is reduced until it finally melts through. The process is facilitated in that the decomposure of the synthetic plastic is an enthodermic process. Surprisingly, the combination of a conductor or iron, aluminum, or zinc respectively alloys thereof with the covering of polyvinylchloride, has shown that a meltable conductor meets the switching-off requirements better than a blank conductor of the same material and constitutes a full-value replacement for meltable conductors of silver and the alloys thereof.

For more delay in the device, polyvinylidenechloride may be used which is more temperature-resistant than polyvinylchloride, i.e. decomposes only at higher temperatures.

A further variation is a safety device in which a meltable conductor—especially on aluminum or zinc basis—is provided with a polyethylene coating. Here, the switching-off behavior of the meltable conductor is influenced exclusively via the endothermic decomposure process of the synthetic cover, again in the sense of an improvement as compared to a blank meltable conductor.

The drawing explains the invention further.

FIG. 1 shows a safety device in longitudinal section;

FIG. 2 shows an enlarged scale cross-section through the meltable conductor forming part of the safety device;

Figure 3:
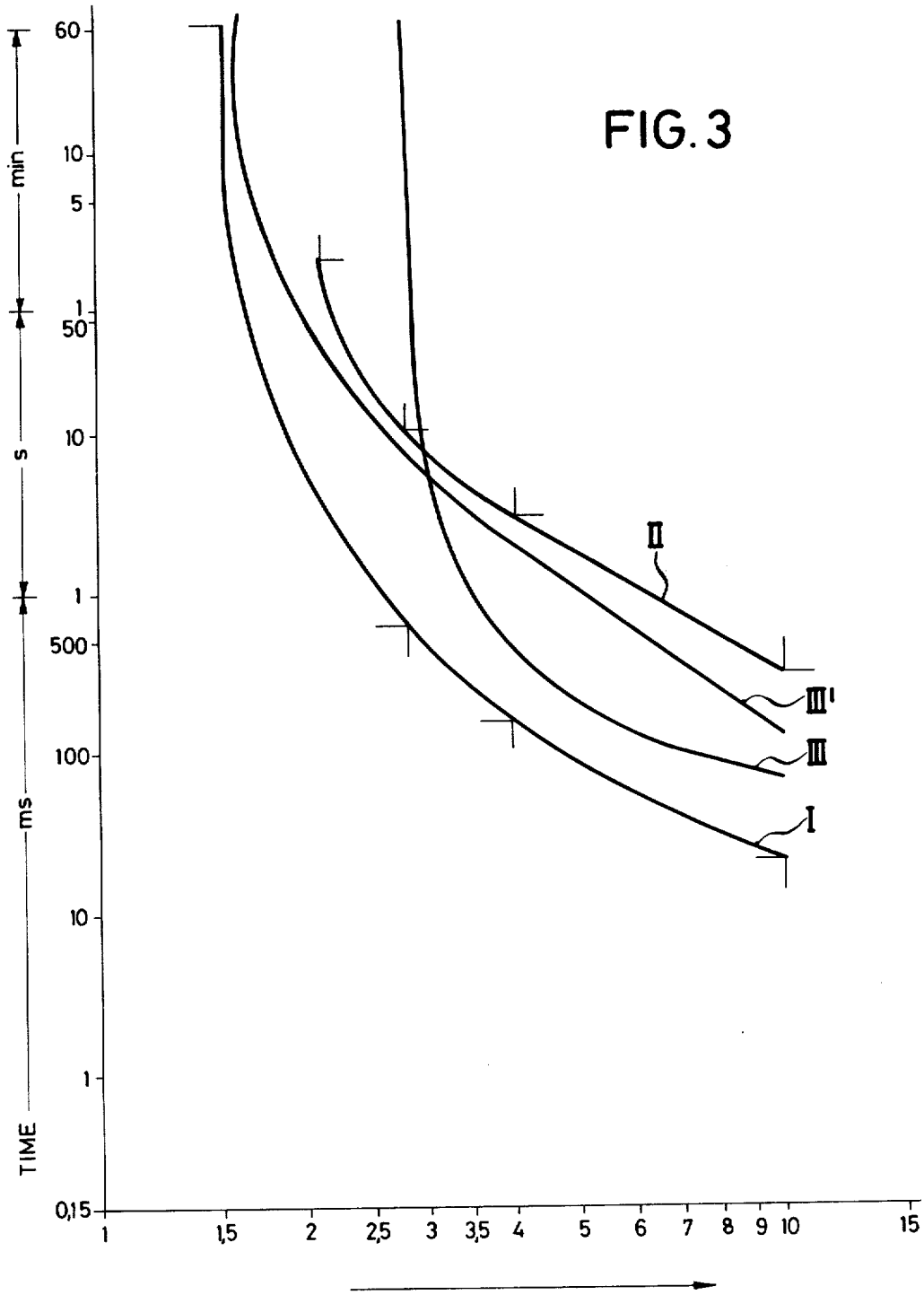
FIG. 3 shows the switching-off diagram of a device having a PVC-coated iron conductor.

FIG. 5a modified embodiment of the safety device in a view analogous to FIG. 1.

The safety device in FIG. 1 consists of the insulating tube 11 which is closed at both ends by contact caps 12 and 13 and through which the meltable conductor 14 extends. As suggested in FIG. 2, the meltable conductor consists of a metallic core 141 which is provided with a covering of synthetic plastic 142.

In the safety device of FIG. 5, the meltable conductor 51 extends between two contact wires 52 and 53 which are pushed through a socket 54 of non-conductive material. A cap 56—into which the socket 54 with the meltable conductor 51 leading is threaded—serves as touch protection for the meltable conductor. The construction of the meltable conductor 51 corresponds to that of conductor 14 in FIGS. 1 and 2.

Figure 4:
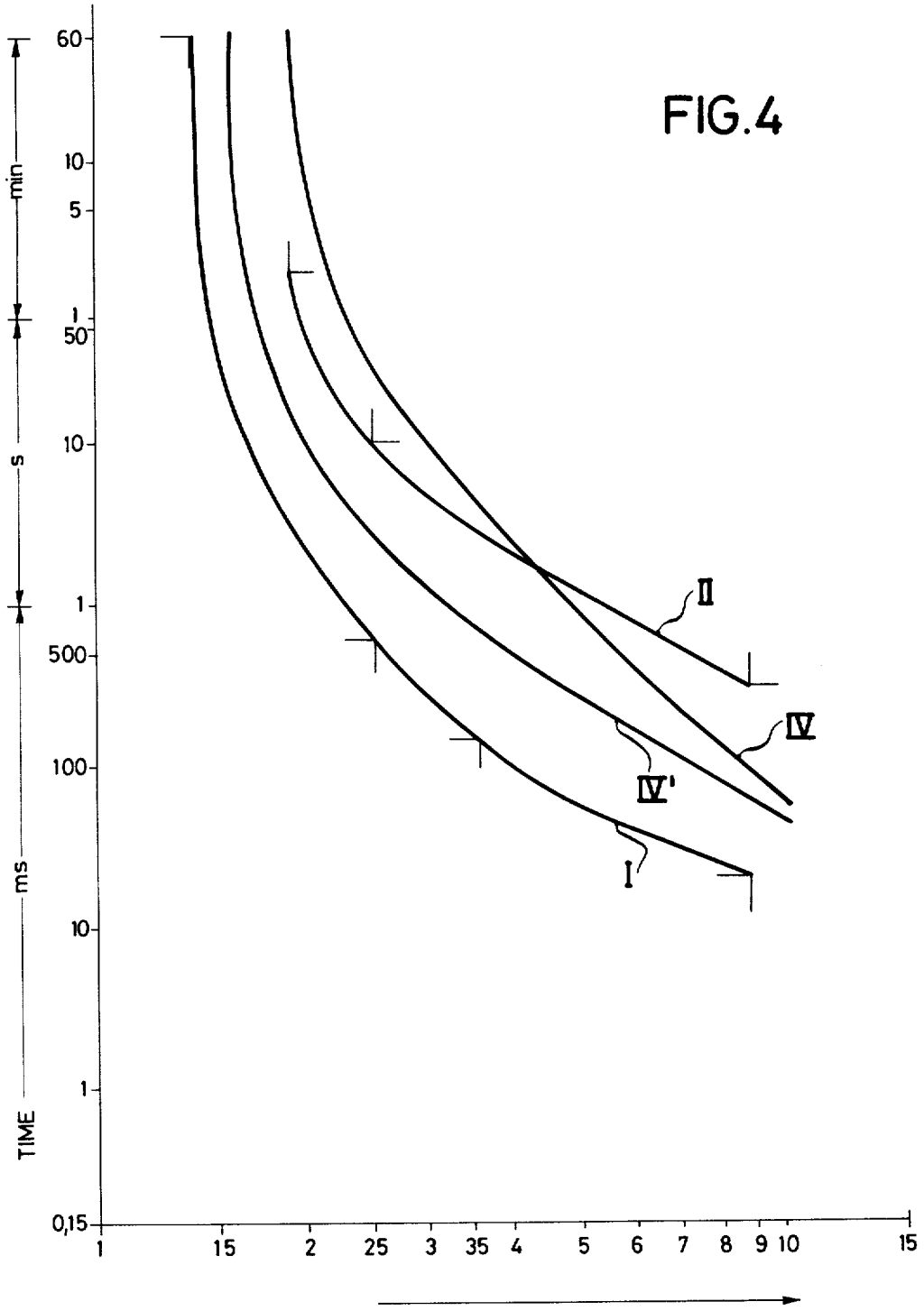
FIG. 4 shows the switching-off diagram of a device having a PVC-coated zinc conductor.

In the switching-off diagrams of FIGS. 3 and 4 the curves I and II each surround the area in which switch-off respectively melt-through of the conductor is to occur.

In both cases the switch-off valves of a blank and of a PVC-coated meltable conductor have been juxtaposed, namely in FIG. 3 a meltable conductor on iron basis and in FIG. 4 a meltable conductor on zinc basis. The blank meltable conductor on iron basis in FIG. 3 1V is designated 111, the PVC-coated meltable conductor 111'. The blank meltable conductor or zinc basis in FIG. 4 is 1V, the PVC coated meltable conductor 1V'.

Both diagrams clearly show that the PVC-coated meltable conductors 111' and 1V' meet the required switching-off condition better than the corresponding blank meltable conductors 111 and 1V which are especially unsatisfactory in the case of lasting overload current. The coated meltable conductors on iron and zinc basis, on the other hand, evidently constitute a full replacement for noble-metal meltable conductors.

I claim:

1. Delayed safety device, comprising: a meltable conductor engaging two contacts; a non-conductive sleeve serving as touch protection and shielding said meltable conductor; said meltable conductor being of a base metal having a coating of synthetic plastic, said coating decomposing when heated and emitting hydrochloric acid, said hydrochloric acid reacting with said meltable conductor and reducing its cross-section, said coating protecting said meltable conductor against corrosion and providing said meltable conductor with a switching-off characteristic which is present when the meltable conductor is made of a noble metal.

2. Device according to claim 1, including an insulating tube closed at both ends by contact caps, through which the meltable conductor extends and engages the contact caps.

3. Device according to claim 1, including a socket of non-conductive material, said two contacts extending through said socket, said meltable contact extending between said socket, said meltable contact being shielded by a cap of non-conductive material placed upon the socket.

4. Device according to claim 1, wherein said coating comprises polyvinylchloride.

5. Device according to claim 1, wherein said coating comprises polyvinylidenechloride.

6. Device according to claim 1, wherein said meltable conductor is substantially of iron.

7. Device according to claim 1, wherein said meltable conductor is substantially of zinc.

8. Device according to claim 1, wherein said meltable conductor is substantially of aluminum.

* * * * *